US009805844B2

(12) United States Patent
Bopp et al.

(10) Patent No.: US 9,805,844 B2
(45) Date of Patent: Oct. 31, 2017

(54) TWISTED PAIR CABLE WITH SHIELDING ARRANGEMENT

(71) Applicant: CommScope Technologies LLC, Hickory, NC (US)

(72) Inventors: Steven Richard Bopp, Jamestown, NC (US); Christine Anne Dooley, Lewisville, NC (US); Brandon Eugene Bristow, Kernersville, NC (US); Shawn Phillip Tobey, Trinity, NC (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 14/748,886

(22) Filed: Jun. 24, 2015

(65) Prior Publication Data

US 2015/0371737 A1 Dec. 24, 2015

Related U.S. Application Data

(60) Provisional application No. 62/016,304, filed on Jun. 24, 2014.

(51) Int. Cl.

| | |
|---|---|
| ***H01B 11/04*** | (2006.01) |
| ***H01B 11/06*** | (2006.01) |
| ***H01B 11/08*** | (2006.01) |
| *H01B 11/10* | (2006.01) |

(52) U.S. Cl.

CPC ..... *H01B 11/08* (2013.01); *H01B 11/1091* (2013.01)

(58) Field of Classification Search

CPC ..... H01B 11/04; H01B 11/06
USPC ..... 174/36, 113 R
See application file for complete search history.

(56) References Cited

U.S. PATENT DOCUMENTS

| | | | | |
|---|---|---|---|---|
| 2,769,148 | A * | 10/1956 | Clogston | H01B 3/08 174/68.1 |
| 4,096,346 | A * | 6/1978 | Stine | B29C 47/128 174/110 AR |
| 4,501,928 | A * | 2/1985 | Ishitobi | B32B 15/08 174/106 SC |
| 5,956,445 | A * | 9/1999 | Deitz, Sr. | G02B 6/441 174/24 |
| 6,452,107 | B1 | 9/2002 | Kebabjian | |

(Continued)

FOREIGN PATENT DOCUMENTS

JP 2010287355 A 12/2010

OTHER PUBLICATIONS

PCT International Search Report and Written Opinion in PCT/US2015/037424, dated Oct. 8, 2015, 13 pages.

*Primary Examiner* — Chau N Nguyen
(74) *Attorney, Agent, or Firm* — Merchant & Gould P.C.

(57) ABSTRACT

A cable includes an insulative main jacket, a main conductive shield and a plurality of subunits. The main conductive shield may be located on an inner side of the insulative main jacket so as to be at least partially surrounded by the insulative main jacket. Each subunit includes a twisted pair of insulated conductors, a conductive subunit shield and a subunit insulative layer. The conductive subunit shield may at least partially surround the twisted pair of insulated conductors. The subunit insulative layer may be located on an outer side of the conductive subunit shield to at least partially surround the conductive subunit shield and the twisted pair of insulated conductors.

4 Claims, 4 Drawing Sheets

(56) References Cited

U.S. PATENT DOCUMENTS

| | | | | |
|---|---|---|---|---|
| 6,686,537 | B1 * | 2/2004 | Gareis | H01B 7/292<br>174/110 R |
| 6,815,611 | B1 * | 11/2004 | Gareis | H01B 11/1025<br>174/113 R |
| 8,664,532 | B1 | 3/2014 | Herrin | |
| 2011/0011639 | A1 * | 1/2011 | Visser | H01B 11/1008<br>174/350 |
| 2012/0090887 | A1 * | 4/2012 | Kanmuri | B32B 15/08<br>174/388 |
| 2014/0096996 | A1 | 4/2014 | Sidlyarevich | |

* cited by examiner

TWISTED PAIR CABLE WITH SHIELDING ARRANGEMENT

CROSS-REFERENCE TO RELATED APPLICATION(S)

This application claims the benefit of U.S. Patent Application Ser. No. 62/016,304, titled Twisted Pair Cable with Shielding Arrangement, filed Jun. 24, 2014, the disclosure of which is hereby incorporated by reference in its entirety.

BACKGROUND

A wide variety of cable arrangements are utilized in the telecommunications industry. Such cable arrangements cables include twisted pair cables. Twisted pair cables include at least one pair of insulated conductors that are twisted about one another to form a pair of two conductors. A plurality of pairs of two conductors can sometimes twist about each other to define a twisted pair core. A plastic jacket is typically extruded over a twisted pair core to maintain the configuration of the core and to function as a protective layer.

As twisted pairs are closely positioned in cables and the cables are positioned close together, electrical energy may be transferred between twisted pairs of adjacent cables. This type of cable-to-cable interference is commonly referred to as alien crosstalk. The telecommunications industry is continuously striving to increase the speed and/or volume of signal transmissions through the cables. One problem that concerns the telecommunications industry is the increased occurrence of alien crosstalk associated with high-speed signal transmissions. Therefore, the increase in signal frequencies associated with the high-speed transmissions requires improved alien crosstalk performance.

In some applications, to reduce the problem of alien crosstalk in a twisted pair cable, a layer of electrical shielding is provided between the core of twisted pairs and the cable jacket. In other applications, the cable includes a layer of electrical shielding that surrounds the core of twisted pairs. However, such existing applications have not been fully satisfactory in achieving smaller diameters of the cables and reducing alien crosstalk while improving signal transmission performance of the cables (e.g., cables for unshielded twisted pair (UTP) applications).

SUMMARY

The present disclosure relates generally to twisted pair cables having different shielding arrangements.

One aspect of the present disclosure relates to a cable including an insulative main jacket, a main shield and a plurality of subunits. The main shield may be located on an inner side of the insulative main jacket so as to be at least partially surrounded by the insulative main jacket. The main shield is configured to be at least partially electrically conductive. The main shield may at least partially surround the subunits. Each subunit includes a twisted pair of insulated conductors, a first subunit shield and a first subunit insulative layer. The first subunit shield is configured to be at least partially electrically conductive and may at least partially surround the twisted pair of insulated conductors. The first subunit insulative layer may be located on an outer side of the first subunit shield and at least partially surround the first subunit shield and the twisted pair of insulated conductors.

In a second embodiment, the subunit of the first embodiment may further include a second subunit insulative layer. The second subunit insulatve layer may be located on an inner side of the first subunit shield and at least partially surround the twisted pair of insulated conductors. The second subunit insulative layer may be also at least partially surrounded by the first subunit shield and the first subunit insulative layer.

In a third embodiment, the subunit of the first embodiment may further include a second subunit shield. The second subunit shield is configured to be at least partially electrically conductive, and may be located on an outer side of the first subunit insulative layer and at least partially surround the first subunit insulative layer, the first subunit shield and the twisted pair of insulated conductors.

In a fourth embodiment, the cable includes an insulative main jacket and a plurality of subunits. The insulative main jacket may at least partially surround the subunits. Each subunit includes a twisted pair of insulated conductors, a first subunit shield and a first subunit insulative layer. The first subunit shield is configured to be at least partially electrically conductive and may at least partially surround the twisted pair of insulated conductors. The first subunit insulative layer may be located on an outer side of the first subunit shield and at least partially surround the first subunit shield and the twisted pair.

In a fifth embodiment, the subunit of the fourth embodiment may further include a second subunit insulative layer. The second subunit insulatve layer may be located on an inner side of the first subunit shield and at least partially surround the twisted pair of insulated conductors. The second subunit insulative layer may be also at least partially surrounded by the first subunit shield and the first subunit insulative layer.

In a sixth embodiment, the subunit of the fourth embodiment may further include a second subunit shield. The second subunit shield is configured to be at least partially electrically conductive, and may be located on an outer side of the first subunit insulative layer and at least partially surround the first subunit insulative layer, the first subunit shield and the twisted pair of insulated conductors.

In a seventh embodiment, the cable includes an insulative main jacket, a main insulative layer, a main shield and a plurality of subunits. The main insulative layer may be located on an inner side of the insulative main jacket and at least partially surrounded by the insulative main jacket. The main shield is configured to be at least partially electrically conductive, and may be located on an inner side of the main insulative layer and at least partially surrounded by the main insulative layer. The main shield may at least partially surround the subunits. Each subunit includes a twisted pair of insulated conductors, an inner subunit insulative layer, and a first subunit shield. The inner subunit insulative layer may at least partially surround the twisted pair of insulated conductors. The first subunit shield is configured to be at least partially electrically conductive, and may be located on an outer side of the inner subunit insulative layer and at least partially surround the inner subunit insulative layer and the twisted pair of insulated conductors.

In an eighth embodiment, the cable includes an insulative main jacket, a main insulative layer, a main shield and a plurality of subunits. The main insulative layer may be located on an inner side of the insulative main jacket and at least partially surrounded by the insulative main jacket. The main shield may be located on an inner side of the main insulative layer so as to be at least partially surrounded by the main insulative layer. The main shield is configured to be at least partially electrically conductive. The main shield may at least partially surround the subunits. Each subunit includes a twisted pair of insulated conductors, a first subunit shield and a first subunit insulative layer. The first subunit shield is configured to be at least partially electrically conductive and may at least partially surround the twisted pair of insulated conductors. The first subunit insulative layer may be located on an outer side of the first subunit shield and at least partially surround the first subunit shield and the twisted pair of insulated conductors.

In a ninth embodiment, the subunit of the eighth embodiment may further include a second subunit insulative layer. The second subunit insulatve layer may be located on an inner side of the first subunit shield and at least partially surround the twisted pair of insulated conductors. The second subunit insulative layer may be also at least partially surrounded by the first subunit shield and the first subunit insulative layer.

In a tenth embodiment, the subunit of the eighth embodiment may further include a second subunit shield. The second subunit shield is configured to be at least partially electrically conductive, and may be located on an outer side of the first subunit insulative layer and at least partially surround the first subunit insulative layer, the first subunit shield and the twisted pair of insulated conductors.

DETAILED DESCRIPTION

Figure 1:
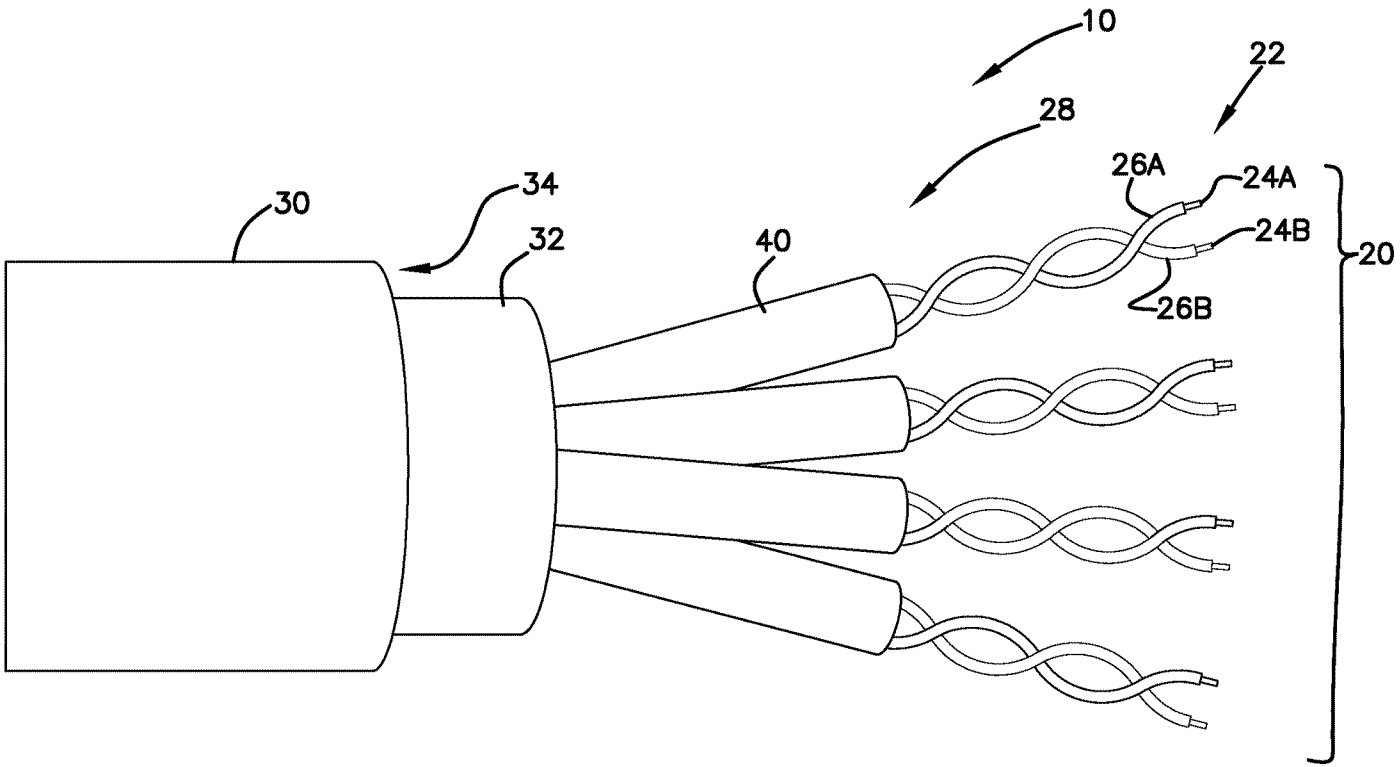
FIG. 1 is a perspective view illustrating a portion of a twisted pair cable according to the principles of the present disclosure.

FIG. 1 is a perspective view illustrating a portion of a twisted pair cable 10 according to the principles of the present disclosure. In the description that follows, the cable 10 will be described in terms of a data communication cable or the like. However, it is to be understood that the benefits described herein are also applicable to other types of cables. The following description is therefore provided for illustrative purposes only and is only one potential application of the subject matter of the present disclosure. In this disclosure, the term "conductive," or other similar phrase, is used to refer to electrical conductivity, and thus can be interchangeably used with "electrically conductive."

Referring to FIG. 1, in general, the twisted pair cable 10 includes a cable core 20, a jacket 30, and a conductive main shield 32. The cable core 20 includes a plurality of subunits 28. In the example of FIG. 1, the cable core 20 includes four subunits 28. Each subunit 28 includes a twisted conductor pair 22 and a subunit shield 40.

The twisted conductor pair 22 includes two conductors 24A and 24B twisted about each other along a longitudinal axis of the pair. The conductors 24A and 24B are at least partially surrounded by insulative layers 26A and 26B, respectively. In some embodiments, the insulative layers 26A and 26B surround an entirety of the circumference of the conductors 24A and 24B. In other embodiments, the insulative layers 26A and 26B can surround only a portion of the circumference of the conductors 24A and 24B. The conductors 24A and 24B may be fabricated from any conductive materials, such as, but not limited to, copper, aluminum, copper-clad steel, plated copper or the like. The conductors 24A and 24B can be solid or braided. The insulative layers 26A and 26B may be fabricated from any insulative, non-conductive materials, such as, but not limited to, polyvinyl chloride (PVC), polypropylene, a polymer, a fluoropolymer, a plastic, polyethylene, or the like.

Each of the conductors 24A and 24B of the individual twisted conductor pairs 22 can be twisted about one another at a continuously changing twist rate, an incremental twist rate, or a constant twist rate. Each of the twist rates of the twisted pairs 22 can further be the same as the twist rates of some or all of the other twisted pairs 22, or different from each of the other twisted pairs 22.

The subunit shield 40 at least partially surrounds the twisted conductor pair 22. In some embodiments, the subunit shield 40 surrounds an entirety of the circumference of the twisted conductor pair 22. In other embodiments, the subunit shield 40 can surround only a portion of the circumference of the twisted conductor pair 22. The subunit shield 40 can be engaged with the twisted conductor pair 22. Alternatively, the subunit shield 40 can have an inner diameter substantially similar to the diameter of the periphery of the twisted conductor pair 22. The subunit shield 40 operates to electrically shield the twisted conductor pair 22 from the other twisted conductor pairs 22 of the cable core 20. The subunit shield 40 reduces an amount of crosstalk between the twisted conductor pairs 22 within the cable 10. The subunit shield 40 can be fabricated from any conductive materials, such as, but not limited to, a laminated metal tape, an aluminum polyimide laminated tape, an aluminum biaxially-oriented polyethylene terephthalate (BoPET) laminated tape, a braid of conductive strands, fibers, a tube formed from a continuous (e.g., a sheet) conductive material, and/or the like.

The cable core 20 of the plurality of twisted pairs 22 can also be twisted about a longitudinal axis of the cable 10. The cable core 20 can be similarly twisted at any of a continuously changing, incremental, or constant twist rate.

The jacket 30 surrounds the cable core 20 or the plurality of subunits 28. In one embodiment, the jacket 30 is made of a non-conductive material such as polyvinyl chloride (PVC), for example. Other types of non-conductive materials can also be used for the jacket, including other plastic materials such as fluoropolymers (e.g. ethylenechlorotrifluorothylene (ECTF) and flurothylenepropylene (FEP)), polyethylene, or other electrically insulating materials. Preferably, the material does not propagate flames or generate a significant amount of smoke.

The cable 10 may further include the conductive main shield 32. The conductive main shield 32 is arranged within the jacket 30 and at least partially extends around the cable core 20, which includes the plurality of twisted pairs 22 and the subunit shields 40. In some embodiments, the conductive main shield 32 is located on an inner side 34 of the jacket 30. The conductive main shield 32 can surround an entirety of the circumference of the cable core 20 or all of the subunits 28, which include the plurality of twisted conductor pairs 22 and the subunit shields 40. In other embodiments, the conductive main shield 32 can surround only a portion of the circumference of the subunits 28. The conductive main shield 32 operates to shield the twisted conductor pairs 22 within the cable 10 from other cables. The conductive main shield 32 reduces an amount of alien crosstalk between different cables. In some examples, the main shield 32 is made of braided strands of metals, such as copper or aluminum. In other examples, the main shield 32 may be fabricated from any conductive materials, such as, but not limited to, a laminated metal tape, an aluminum polyimide laminated tape, an aluminum biaxially-oriented polyethylene terephthalate (BoPET) laminated tape, a braid of conductive strands, fibers, a tube formed from a continuous (e.g., a sheet) conductive material, and/or the like. In some embodiments, the conductive main shield 32 is optionally connected to a ground.

FIGS. 2-11 illustrate embodiments of a twisted pair cable 10 with different shielding configurations. Preferred features of the cable 10 with these shielding arrangements include improvement of alien crosstalk performance and reduction in the size of the cable, as well as improvement of signal transmission performance. As many of the configurations of the following embodiments are the same as the twisted pair cable 10 shown in FIG. 1, the detailed description of the cable 10 is hereinafter omitted for brevity purposes.

Figure 2:
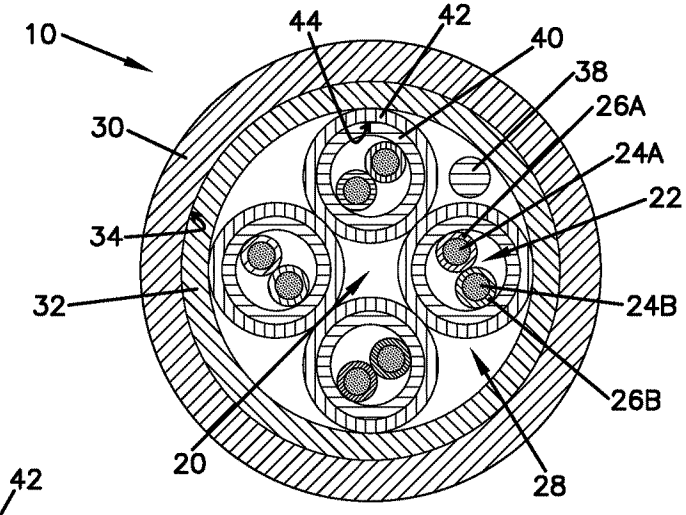
FIG. 2 is a schematic, cross-sectional view of a first embodiment of a shielding configuration for the twisted pair cable.

FIG. 2 is a schematic, cross-sectional view of a first embodiment of a shielding configuration for the twisted pair cable 10. The cable 10 includes the cable core 20 having a plurality of subunits 28. Each of the subunits 28 includes the twisted conductor pair 22 that is at least partially surrounded by the subunit shield 40, which is referred to hereinafter as the "first subunit shield." The cable 10 also includes the jacket 30 and the conductive main shield 32 that is arranged within the jacket 30. The conductive main shield 32 and the jacket 30 at least partially surround the cable core 20.

In this embodiment, the subunit 28 further includes a first subunit insulative layer 42. The first subunit insulative layer 42 is arranged on an outer side 44 of the first subunit shield 40, and at least partially surrounds the first subunit shield 40 and the twisted conductor pair 22. The first subunit insulative layer 42 operates to isolate the first subunit shield 40 from adjacent conductive materials, such as the main shield 32, other first subunit shields 40 and a drain wire 38, and prevent the first subunit shield 40 from contacting the adjacent conductive materials. Thus, even if the cable core 20 is tightly packed within the main shield 32 and the jacket 30, the first subunit shield 40 can avoid being engaged with the main shield 32 along the length of the cable 10.

The first subunit insulative layer 42 can be fabricated from any insulative, non-conductive materials. In a preferred example, the first subunit insulative layer 42 is made from a polyester film or a plastic film, such as biaxially-oriented polyethylene terephthalate (BoPET). Examples of the polyester film or plastic film include a Mylar® distributed by DuPont Teijin Films. In other embodiments, the first subunit insulative layer 42 is made from any insulative, non-conductive materials, such as, but not limited to, polyvinyl chloride (PVC), polypropylene, a polymer, a fluoropolymer, polyethylene, or the like.

Optionally, the cable 10 further includes the drain wire 38. The drain wire 38 can be located within the main shield 32 between the main shield 32 and the first subunit insulative layer 42. The drain wire 38 extends along an entire length of the cable 10. The drain wire 38 can be electrically connected to the main shield 32 and provide an electrical connection between the main shield 32 and a ground. The first subunit shield 40 is isolated from the drain wire 38 and the main shield 32 by the first subunit insulative layer 42. As such, the first subunit shield 40 is configured to float within the cable 10 and out of engagement with the main shield 32. In other embodiments, however, the first subunit shield 40 is electrically connected to the drain wire 38 so that the first subunit shield 40 is connected to a ground. In yet other embodiments, the first subunit shield 40 can be electrically connected to the main shield 32 by partially engaging with the main shield 32, or via the drain wire 38.

Figure 3:
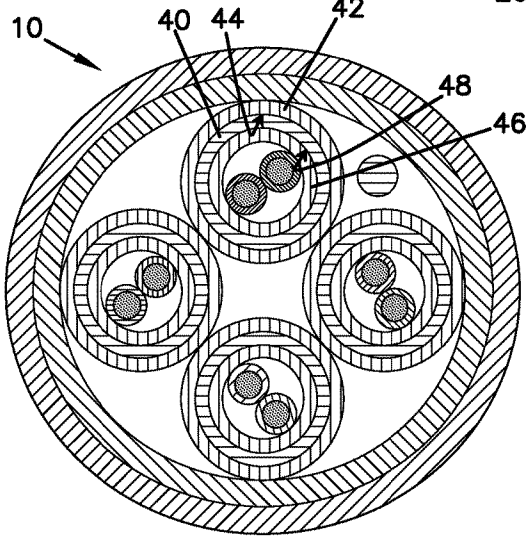
FIG. 3 is a schematic, cross-sectional view of a second embodiment of a shielding configuration for the twisted pair cable.

FIG. 3 is a schematic, cross-sectional view of a second embodiment of a shielding configuration for the twisted pair cable 10. As many of the concepts and features are similar to the first embodiment shown in FIG. 2, the description for the first embodiment is hereby incorporated by reference for the second embodiment.

In this embodiment, in addition to the first subunit insulative layer 42, the subunit 28 further includes a second subunit insulative layer 46. The second subunit insulative layer 46 is arranged on an inner side 48 of the first subunit shield 40 and at least partially surrounds the twisted conductor pair 22. The second subunit insulative layer 46 is at least partially surrounded by the first subunit shield 40, which is partially surrounded by the first subunit insulative layer 42. The second subunit insulative layer 46 operates to isolate the first subunit shield 40 from the adjacent twisted conductor pair 22 and prevent the first subunit shield 40 from contacting the twisted conductor pair 22. Thus, even if the twisted conductor pair 22 is tightly packed within the subunit 28, the first subunit shield 40 can avoid being electrically engaged with the twisted conductor pair 22 along the length of the cable 10.

The second subunit insulative layer 46 can be fabricated from any insulative, non-conductive materials. In a preferred example, the second subunit insulative layer 46 is made from a polyester film or a plastic film, such as biaxially-oriented polyethylene terephthalate (BoPET). Examples of the polyester film or plastic film include a Mylar® distributed by DuPont Teijin Films. In other embodiments, the second subunit insulative layer 46 is made from any insulative, non-conductive materials, such as, but not limited to, polyvinyl chloride (PVC), polypropylene, a polymer, a fluoropolymer, polyethylene, or the like.

Figure 4:
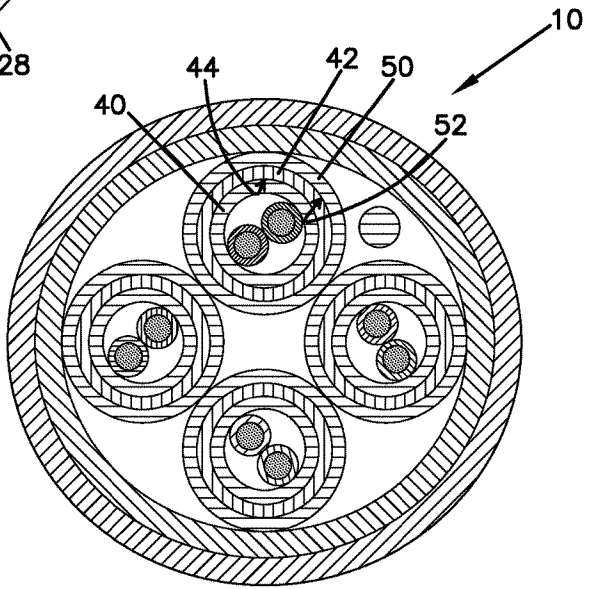
FIG. 4 is a schematic, cross-sectional view of a third embodiment of a shielding configuration for the twisted pair cable.

FIG. 4 is a schematic, cross-sectional view of a third embodiment of a shielding configuration for the twisted pair cable 10. As many of the concepts and features are similar to the first embodiment shown in FIG. 2, the description for the first embodiment is hereby incorporated by reference for the third embodiment.

In this embodiment, in addition to the first subunit shield 40, the subunit 28 further includes a second subunit shield 50. The second subunit shield 50 is arranged on an outer side 52 of the first subunit insulative layer 42 and at least partially surrounds the first subunit insulative layer 42, which at least partially surrounds the first subunit shield 40 and the twisted conductor pair 22. The second subunit shield 50 operates to provide additional shielding effect to further reduce an amount of crosstalk between the twisted conductor pairs 22 within the cable 10. The second subunit shield 50 can be fabricated from any conductive materials, such as, but not limited to, a laminated metal tape, an aluminum polyimide laminated tape, an aluminum biaxially-oriented polyethylene terephthalate (BoPET) laminated tape, a braid of conductive strands, fibers, a tube formed from a continuous (e.g., a sheet) conductive material, and/or the like.

The second subunit shield 50 can be electrically connected to the main shield 32 by engaging with the main shield 32. In other embodiments, the second subunit shield 50 can be electrically connected to the main shield 32 via the drain wire 38. The drain wire 38 can be electrically connected to the second subunit shield 50 and provide an electrical connection between the second subunit shield 50 and a source of ground. The first subunit shield 40 is isolated from the drain wire 38 and the main shield 32 by the first subunit insulative layer 42. As such, the first subunit shield 40 is configured to float within the cable 10 and out of engagement with the main shield 32. In other embodiments, however, the first subunit shield 40 is electrically connected to the drain wire 38 so that the first subunit shield 40 is connected to a source of ground.

In yet other embodiments, the first subunit shield 40 can be electrically connected to the second subunit shield 50 and/or the main shield 32 by partially engaging with the second subunit shield 50 and/or the main shield 32, or via the drain wire 38.

Figure 5:
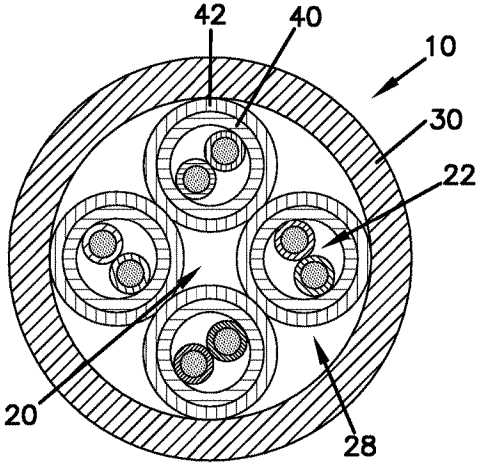
FIG. 5 is a schematic, cross-sectional view of a fourth embodiment of a shielding configuration for the twisted pair cable.

FIG. 5 is a schematic, cross-sectional view of a fourth embodiment of a shielding configuration for the twisted pair cable 10. As many of the concepts and features are similar to the first embodiment shown in FIG. 2, the description for the first embodiment is hereby incorporated by reference for the fourth embodiment.

The twisted pair cable 10 in this embodiment has the same configuration as the cable 10 in the first embodiment (FIG. 2), except for the conductive main shield 32 and the drain wire 38. In this embodiment, the cable 10 does not have the main shield 32 as shown in FIG. 2. Thus, the cable 10 has a smaller cable diameter while it still can reduce an amount of crosstalk between the adjacent twisted conductor pairs 22 by the first subunit shield 40. The cable 10 also does not include the drain wire 38 that could otherwise be used to provide an electrical connection between the main shield 32 and a source of ground. As in the first embodiment, the first subunit shields 40 are configured to float within the cable 10. In other embodiments, however, the drain wire 38 can be placed within the cable 10 to provide an electrical connection between the first subunit shields 40 and a source of ground.

Figure 6:
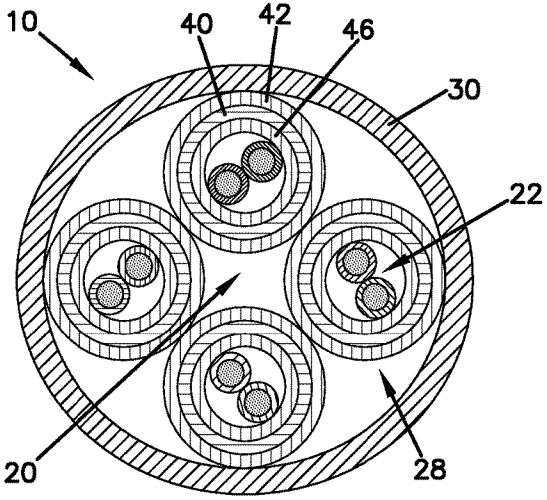
FIG. 6 is a schematic, cross-sectional view of a fifth embodiment of a shielding configuration for the twisted pair cable.

FIG. 6 is a schematic, cross-sectional view of a fifth embodiment of a shielding configuration for the twisted pair cable 10. As many of the concepts and features are similar to the second embodiment shown in FIG. 3, the description for the second embodiment is hereby incorporated by reference for the fifth embodiment.

The twisted pair cable 10 in this embodiment has the same configuration as the cable 10 in the second embodiment (FIG. 3), except for the conductive main shield 32 and the drain wire 38. In this embodiment, the cable 10 does not have the main shield 32 as shown in FIG. 3. Thus, the cable 10 has a smaller cable diameter while it still can reduce an amount of crosstalk between the adjacent twisted conductor pairs 22 by the first subunit shield 40. The cable 10 also does not include the drain wire 38 that could otherwise be used to provide an electrical connection between the main shield 32 and a source of ground. As in the second embodiment, the first subunit shields 40 are configured to float within the cable 10. In other embodiments, however, the drain wire 38 can be placed within the cable 10 to provide an electrical connection between the first subunit shields 40 and a source of ground.

Figure 7:
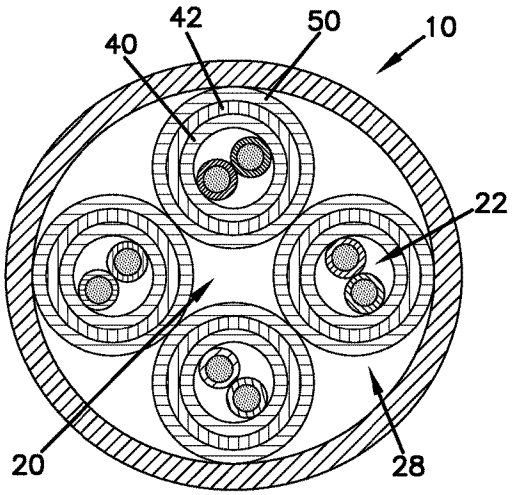
FIG. 7 is a schematic, cross-sectional view of a sixth embodiment of a shielding configuration for the twisted pair cable.

FIG. 7 is a schematic, cross-sectional view of a sixth embodiment of a shielding configuration for the twisted pair cable 10. As many of the concepts and features are similar to the third embodiment shown in FIG. 4, the description for the third embodiment is hereby incorporated by reference for the sixth embodiment.

The twisted pair cable 10 in this embodiment has the same configuration as the cable 10 in the third embodiment (FIG. 4), except for the conductive main shield 32 and the drain wire 38. In this embodiment, the cable 10 does not have the main shield 32 as shown in FIG. 4. Thus, the cable 10 has a smaller cable diameter while it still can reduce an amount of crosstalk between the adjacent twisted conductor pairs 22 by the first subunit shield 40 and the second subunit shield 50. The cable 10 also does not include the drain wire 38 that could otherwise be used to provide an electrical connection between the main shield 32 and a source of ground. In other embodiments, however, the drain wire 38 can be located within the cable 10 to provide an electrical connection between the second subunit shields 50 and a source of ground. As in the third embodiment, the first subunit shields 40 are configured to float within the cable 10. In other embodiments, however, the drain wire 38 can be placed within the cable 10 to provide an electrical connection between the first subunit shields 40 and a source of ground.

Figure 8:
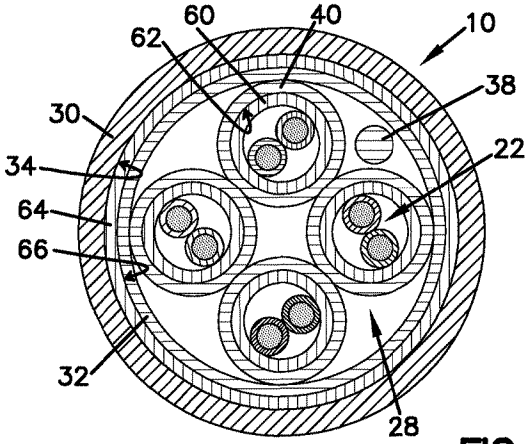
FIG. 8 is a schematic, cross-sectional view of a seventh embodiment of a shielding configuration for the twisted pair cable.

FIG. 8 is a schematic, cross-sectional view of a seventh embodiment of a shielding configuration for the twisted pair cable 10. As many of the concepts and features are similar to the first embodiment shown in FIG. 2, the description for the first embodiment is hereby incorporated by reference for the seventh embodiment. The twisted pair cable 10 in this embodiment has the same configuration as the cable 10 in the first embodiment (FIG. 2), except for a main insulative layer 64 and the arrangement of an inner subunit insulative layer 60.

In this embodiment, the cable 10 further includes the main insulative layer 64. The main insulative layer 64 is arranged between the jacket 30 and the main shield 32. For example, the main insulative layer 64 is located on an inner side 34 of the jacket 30 and is at least partially surrounded by the jacket 30. Furthermore, the main insulative layer 64 is located on the outer side 66 of the main shield 32 and at least partially surrounds the main shield 32. The main insulative layer 64 can be fabricated from any insulative, non-conductive materials. In a preferred example, the main insulative layer 64 is made from a polyester film or a plastic film, such as biaxially-oriented polyethylene terephthalate (BoPET). Examples of the polyester film or plastic film include a Mylar® distributed by DuPont Teijin Films. In other embodiments, the main insulative layer 64 is made from any insulative, non-conductive materials, such as, but not limited to, polyvinyl chloride (PVC), polypropylene, a polymer, a fluoropolymer, polyethylene, or the like.

In this embodiment, the subunit 28 includes the inner subunit insulative layer 60, instead of the first subunit insulative layer 42 as illustrated in the first embodiment (FIG. 2). The primary difference between the inner subunit insulative layer 60 and the first subunit insulative layer 42 is their arrangement with respect to the first subunit shield 40. The inner subunit insulative layer 60 is arranged on an inner side 62 of the first subunit shield 40 and is at least partially surrounded by the first subunit shield 40. The inner subunit insulative layer 60 at least partially surrounds the twisted conductor pair 22. The inner subunit insulative layer 60 can be fabricated from any insulative, non-conductive materials. In a preferred example, the first subunit insulative layer 42 is made from a polyester film or a plastic film, such as biaxially-oriented polyethylene terephthalate (BoPET). Examples of the polyester film or plastic film include a Mylar® distributed by DuPont Teijin Films. In other embodiments, the inner subunit insulative layer 60 is made from any insulative, non-conductive materials, such as, but not limited to, polyvinyl chloride (PVC), polypropylene, a polymer, a fluoropolymer, polyethylene, or the like.

Optionally, the first subunit shield 40 can be electrically engaged with the main shield 32 so that the first subunit shield 40 is connected to a source of ground via the drain wire 38 that provides an electrical connection between the main shield 32 and the source of ground. In other embodiments, the first subunit shield 40 can be directly electrically engaged with the drain wire 38 so as to be connected to a source of ground.

Figure 9:
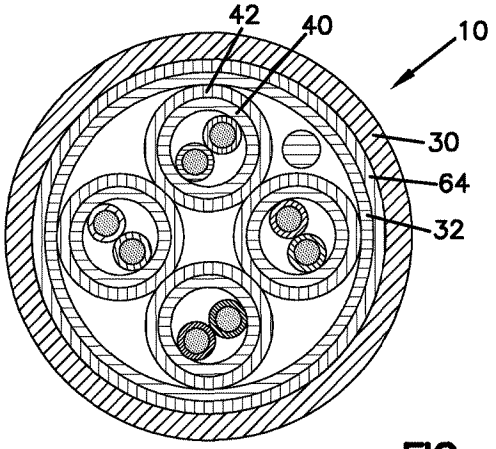
FIG. 9 is a schematic, cross-sectional view of an eighth embodiment of a shielding configuration for the twisted pair cable.

FIG. 9 is a schematic, cross-sectional view of an eighth embodiment of a shielding configuration for the twisted pair cable 10. As many of the concepts and features are similar to the first embodiment shown in FIG. 2, the description for the first embodiment is hereby incorporated by reference for the eighth embodiment.

The twisted pair cable 10 in this embodiment has the same configuration as the cable 10 in the first embodiment (FIG. 2), except for the main insulative layer 64. As described in the seventh embodiment with reference to FIG. 8, the main insulative layer 64 is arranged between the jacket 30 and the main shield 32. For example, the main insulative layer 64 is located on an inner side 34 of the jacket 30 and is at least partially surrounded by the jacket 30. Furthermore, the main insulative layer 64 is located on the outer side 66 of the main shield 32 and at least partially surrounds the main shield 32. As in the first embodiment, the first subunit shield 40 is configured to float within the cable 10. In other embodiments, however, the drain wire 38 can be placed within the cable 10 to provide an electrical connection between the first subunit shield 40 and a source of ground.

Figure 10:
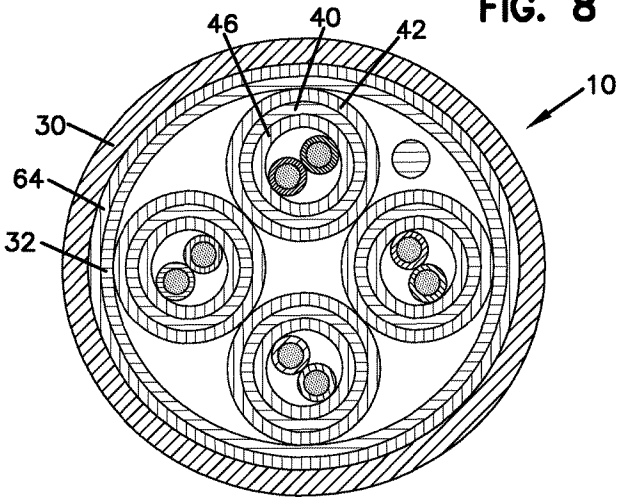
FIG. 10 is a schematic, cross-sectional view of a ninth embodiment of a shielding configuration for the twisted pair cable.

FIG. 10 is a schematic, cross-sectional view of a ninth embodiment of a shielding configuration for the twisted pair cable 10. As many of the concepts and features are similar to the second embodiment shown in FIG. 3, the description for the second embodiment is hereby incorporated by reference for the ninth embodiment.

The twisted pair cable 10 in this embodiment has the same configuration as the cable 10 in the second embodiment (FIG. 3), except for the main insulative layer 64. As described in the seventh embodiment with reference to FIG. 8, the main insulative layer 64 is arranged between the jacket 30 and the main shield 32. For example, the main insulative layer 64 is located on an inner side 34 of the jacket 30 and is at least partially surrounded by the jacket 30. Furthermore, the main insulative layer 64 is located on the outer side 66 of the main shield 32 and at least partially surrounds the main shield 32. As in the first embodiment, the first subunit shield 40 is configured to float within the cable 10. In other embodiments, however, the drain wire 38 can be placed within the cable 10 to provide an electrical connection between the first subunit shield 40 and a source of ground.

Figure 11:
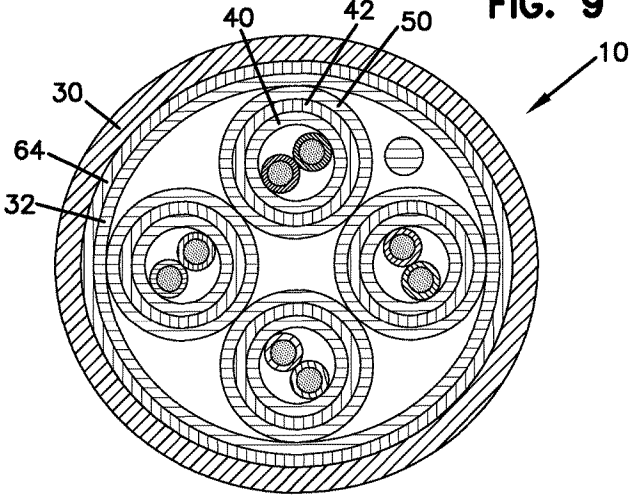
FIG. 11 is a schematic, cross-sectional view of a tenth embodiment of a shielding configuration for the twisted pair cable.

FIG. 11 is a schematic, cross-sectional view of a tenth embodiment of a shielding configuration for the twisted pair cable 10. As many of the concepts and features are similar to the third embodiment shown in FIG. 4, the description for the third embodiment is hereby incorporated by reference for the tenth embodiment.

The twisted pair cable 10 in this embodiment has the same configuration as the cable 10 in the third embodiment (FIG. 4), except for the main insulative layer 64. As described in the seventh embodiment with reference to FIG. 8, the main insulative layer 64 is arranged between the jacket 30 and the main shield 32. For example, the main insulative layer 64 is located on an inner side 34 of the jacket 30 and is at least partially surrounded by the jacket 30. Furthermore, the main insulative layer 64 is located on the outer side 66 of the main shield 32 and at least partially surrounds the main shield 32. As in the first embodiment, the first subunit shield 40 is configured to float within the cable 10. In other embodiments, however, the drain wire 38 can be placed within the cable 10 to provide an electrical connection between the first subunit shield 40 and a source of ground.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A cable comprising:

an insulative main jacket;

a main insulative layer located on an inner side of the insulative main jacket and at least partially surrounded by the insulative main jacket, the main insulative layer made from BoPET, the main insulative layer at least partially contacting directly with the insulative main jacket;

a main shield located on an inner side of the main insulative layer and at least partially surrounded by the main insulative layer, the main shield being at least partially electrically conductive, the main shield at least partially contacting directly with the main insulative layer; and a plurality of subunits at least partially surrounded by the main shield and the insulative main jacket, the plurality of subunits configured to contact with the main shield, each subunit comprising:

a twisted pair of insulated conductors;

an inner subunit insulative layer at least partially surrounding the twisted pair, the inner subunit insulative layer made from BoPET; and a first subunit shield located on an outer side of the inner subunit insulative layer and at least partially surrounding the inner subunit insulative layer and the twisted pair, the first subunit shield being at least partially electrically conductive.

2. A cable comprising:

an insulative main jacket;

a main insulative layer located on an inner side of the insulative main jacket and at least partially surrounded by the insulative main jacket, the main insulative layer made from BoPET, the main insulative layer at least partially contacting directly with the insulative main jacket;

a main shield located on an inner side of the main insulative layer and at least partially surrounded by the main insulative layer, the main shield being at least partially electrically conductive, the main shield at least partially contacting directly with the main insulative layer; and a plurality of subunits at least partially surrounded by the main shield and the insulative main jacket, the plurality of subunits configured to contact with the main shield, each subunit comprising:

a twisted pair of insulated conductors;

a first subunit shield at least partially surrounding the twisted pair, the first subunit shield being at least partially electrically conductive; and a first subunit insulative layer located on an outer side of the first subunit shield and at least partially surrounding the first subunit shield and the twisted pair, the first subunit insulative layer made from BoPET.

3. The cable of claim 2, wherein each subunit further comprises a second subunit insulative layer located on an inner side of the first subunit shield and at least partially surrounding the twisted pair, the second subunit insulative layer at least partially surrounded by the first subunit shield and the first subunit insulative layer.

4. The cable of claim 2, wherein each subunit further comprises a second subunit shield located on an outer side of the first subunit insulative layer and at least partially surrounding the first subunit insulative layer, the first subunit shield and the twisted pair, the second subunit shield being at least partially electrically conductive.

* * * * *